US009393622B2

(12) United States Patent
Jakimov et al.

(10) Patent No.: US 9,393,622 B2
(45) Date of Patent: Jul. 19, 2016

(54) THIN-WALLED STRUCTURAL COMPONENT, AND METHOD FOR THE PRODUCTION THEREOF

(75) Inventors: Andreas Jakimov, Munich (DE); Erwin Bayer, Dachau (DE); Karl-Heinz Dusel, Unterschleissheim (DE); Carsten Butz, Munich (DE)

(73) Assignee: MTU Aero Engines GmbH, Munich (DE)

( * ) Notice: Subject to any disclaimer, the term of this patent is extended or adjusted under 35 U.S.C. 154(b) by 146 days.

(21) Appl. No.: 13/391,155

(22) PCT Filed: Aug. 9, 2010

(86) PCT No.: PCT/DE2010/000946

§ 371 (c)(1), (2), (4) Date: Mar. 19, 2012

(87) PCT Pub. No.: WO2011/020462

PCT Pub. Date: Feb. 24, 2011

(65) Prior Publication Data

US 2012/0171041 A1 Jul. 5, 2012

(30) Foreign Application Priority Data

Aug. 18, 2009 (DE) ..... 10 2009 037 894

(51) Int. Cl.
*B05D 3/02* (2006.01)
*B05D 1/12* (2006.01)
(Continued)

(52) U.S. Cl.
CPC ..... *B22F 7/08* (2013.01); *C22C 1/0433* (2013.01); *C23C 24/04* (2013.01)

(58) Field of Classification Search
CPC ..... B22F 7/08; C22C 1/0433; C22C 24/04
USPC ..... 427/376.7
See application file for complete search history.

(56) References Cited

U.S. PATENT DOCUMENTS 5,223,332 A * 6/1993 Quets ..... C23C 4/02 428/216
6,089,444 A * 7/2000 Slattery et al. ..... 228/194
(Continued)

FOREIGN PATENT DOCUMENTS

CA 26 69 052 5/2008
DE 10300966 7/2004
(Continued)

OTHER PUBLICATIONS

Inconel 718 Alloy (<<http://www.specialmetals.com/documents/Inconel%20alloy20%20718.pdf>>, 2007).*
(Continued)

*Primary Examiner* — Alexander Weddle
(74) *Attorney, Agent, or Firm* — Davidson, Davidson & Kappel, LLC

(57) ABSTRACT

A method for producing a thin-walled structural component from a casting material. The casting material is supplied as a powder, and the powder is deposited on a support (1) by a kinetic cold gas spraying process so as to form the structural component (11, 11'). A structural component which is made of a casting material and in which the structure is formed from a plurality of particles (17) that are interlinked and deformed using a cold gas spraying process.

16 Claims, 1 Drawing Sheet

(51) Int. Cl.

| | |
|---|---|
| ***B29C 41/08*** | (2006.01) |
| ***B22F 7/08*** | (2006.01) |
| ***C22C 1/04*** | (2006.01) |
| ***C23C 24/04*** | (2006.01) |

(56) References Cited

U.S. PATENT DOCUMENTS

| | | | | |
|---|---|---|---|---|
| 6,408,928 | B1 | 6/2002 | Heinrich et al. | 164/46 |
| 6,639,313 | B1 * | 10/2003 | Martin | B81B 7/0051 257/432 |
| 6,949,299 | B2 | 9/2005 | Roche et al. | 428/546 |
| 7,201,940 | B1 * | 4/2007 | Kramer | 427/189 |
| 7,367,488 | B2 * | 5/2008 | Payne et al. | 228/119 |
| 7,479,299 | B2 * | 1/2009 | Raybould et al. | 427/191 |
| 8,012,601 | B2 | 9/2011 | Krueger et al. | 505/473 |
| 2002/0066770 | A1 | 6/2002 | William et al. | 228/119 |
| 2004/0188124 | A1 * | 9/2004 | Stark | B81B 7/0067 174/535 |
| 2004/0219464 | A1 * | 11/2004 | Dunham et al. | 430/320 |
| 2006/0166020 | A1 * | 7/2006 | Raybould | C23C 24/04 428/471 |
| 2007/0036905 | A1 * | 2/2007 | Kramer | 427/421.1 |
| 2007/0084582 | A1 * | 4/2007 | Govern | B23K 9/0026 164/137 |
| 2007/0144621 | A1 * | 6/2007 | Farmer et al. | 148/403 |
| 2008/0102220 | A1 * | 5/2008 | Haynes | C23C 4/12 427/421.1 |
| 2009/0064685 | A1 * | 3/2009 | Busekros | F01D 25/28 60/797 |
| 2009/0120539 | A1 * | 5/2009 | Ko | C23C 24/04 148/513 |
| 2009/0155461 | A1 | 6/2009 | Jabado et al. | 427/180 |
| 2009/0176110 | A1 * | 7/2009 | Pabla et al. | 428/450 |
| 2010/0015467 | A1 | 1/2010 | Zimmermann et al. | 428/615 |
| 2010/0297345 | A1 | 11/2010 | Jensen et al. | 427/142 |

FOREIGN PATENT DOCUMENTS

| | | | | |
|---|---|---|---|---|
| DE | 10317797 | 11/2004 | | |
| DE | 10 2007 046 386 | 10/2008 | | |
| DE | 10 2007 056 454 | 5/2009 | | |
| DE | 10 2004 059 716 | 9/2011 | | |
| EP | 10 83 013 | 3/2001 | | |
| EP | 19 03 127 | 3/2008 | | |
| EP | 20 62 997 | 5/2009 | | |
| WO | WO 2004/078010 | 9/2004 | | |
| WO | WO 2006/061384 | 6/2006 | | |
| WO | WO 2006/083603 | 8/2006 | | |
| WO | WO2006/083603 | * 8/2006 | | B05D 7/00 |
| WO | 2006/083603 | * 10/2006 | | B05D 7/00 |
| WO | WO 2006/117145 | 11/2006 | | |
| WO | WO 2007/080042 | 7/2007 | | |

OTHER PUBLICATIONS

Pattinson et al.: "Cold gas dynamicmanufacturing: A non-thermal approach to freeform fabrication", International Journal of Machine Tool Design and Research, Pergamon Press, Oxford, GB, col. 47, No. 3 to 4, Dec. 15, 2006, pp. 627-634.

Ichikawa et al.:"Adhesion Study of cold-sprayed CoNiCrAlY—Mo coating of Iconel 625 using the laser shock adhesion test (LASAT)." Materials Science Forum, Aedermannsfdorf, CH, vol. 539-543, Jan. 1, 2007, pp. 1086-1091.

Vicek et al: Einsatzmoeglichkeiten von Kaltgespritzten Schichten in der Luft und Raumfahrtindustrie//Industrial Application of Cold Spray coatings in the aircraft and space industry,: Galvanotechnik, Eugen G. Leutze Verlag, Saulgau, Wurtt, DE, vol. 96, No. 3, Mar. 1, 2005, pp. 684-699.

* cited by examiner

THIN-WALLED STRUCTURAL COMPONENT, AND METHOD FOR THE PRODUCTION THEREOF

The present invention relates to a method for manufacturing a thin-walled structural component, and to such a structural component, preferably for a gas turbine, in particular for an aircraft engine.

BACKGROUND

In gas turbines, in particular gas turbines used as aircraft engines in aviation, the airfoils and flow ducts used in the hot sections of an engine need to be formed with guide segments that are subject to the high temperatures of the gases. Such components are made from high-temperature resistant materials, which are processed using casting techniques. However, cast structures, in particular those used for thin-walled components, have a tendency to develop porosity and distort during heat treatment. The cast microstructure is mostly coarse-grained and may contain segregations, as a result of which the properties required of the thin-walled structural component cannot be ensured throughout the entire component.

SUMMARY OF THE INVENTION

As an alternative to such a casting process, with or without a subsequent forging process, such components may also be manufactured by laser sintering or laser powder deposition welding. However, such techniques require very long manufacturing times and are therefore very ineffective for thin-walled structural components having large surface areas.

It is an object of the present invention to provide a method for manufacturing thin-walled structural components, especially ones having large surface areas, in particular for gas turbines and aircraft engines, which method is simple and effective to implement. Another object is to provide high-temperature resistant components having small wall-thicknesses, such as airfoils or guide segments of aircraft engines.

The present invention provides that thin-walled structural components can advantageously be produced by kinetic cold gas spraying or kinetic cold gas compacting. The kinetic cold gas compacting method makes it possible to produce a homogeneous microstructure without great variations in chemical composition over the entire extent of the component, so that a very compact and dense structure without porosity can be obtained. This makes it possible to avoid the disadvantages of thin cast structures, such as porosity, coarse grain size and segregation.

In order to manufacture the thin-walled structural component, a suitable powder may be deposited by cold gas spraying on a substrate which, at least on a side where the deposition takes place, represents a negative mold of a functional surface of the structural component. In the case of a guide segment or airfoil for an aircraft engine, said functional surface or side may be the surface that is intended for directing and guiding the hot gases. Of course, the substrate member may also have a plurality of surfaces for depositing powders by kinetic cold gas compacting and, respectively, the structural component may have a plurality of functional sides or surfaces. Overall, the method is capable of producing nearly any desired three-dimensional structure, in particular when the method is carried out repeatedly in several steps, in which case no substrate is needed during later deposition steps performed using the kinetic cold gas compacting method. Instead, the deposition can take place directly on the already existing semifinished product.

"Thin-walled structural components" are understood to be components, whose thickness is very much smaller than the length or width, especially components where the thickness of the component or of parts of the component is only 1/10 of the length or width, in particular 1/50 or less of the length or width of the component.

In particular in the case of thin-walled structural components which, in accordance with the present invention, are manufactured by kinetic cold gas spraying of powder onto a substrate, the structural component can also be subjected to a heat treatment without distortion, provided the heat treatment is carried out while the structural component is still on the substrate. This makes it possible to reliably prevent distortion, such as may occur during heat treatment of thin-walled castings.

After the cold gas spraying and/or a heat treatment, the structural component can be separated from the substrate. However, it is also conceivable for the substrate or parts thereof to remain attached to the structural component as an expendable mold.

The substrate may have at least one surface on which the powder particles impinge and deposit during kinetic cold gas spraying. The corresponding surface of the so-formed structural component may constitute a functional surface of the structural component.

Moreover, the substrate and its negative mold may be configured such that corresponding functional elements of the structural component are formed directly during the manufacturing process. Examples of such functional elements include holes, cutouts, recesses and the like. Accordingly, the substrate only needs to include a negative mold in the form of corresponding projections on the surface that receives the powder particles during cold gas spraying.

The substrate can be formed of different materials, such as, for example, ceramic, steel, hardened steel, glass, quartz glass, stone (e.g. granite), etc.

Thus, numerous materials may be used as substrate materials, provided they have the required rigidity or strength to withstand the impact of the particles impinging with the high velocities required.

It is also advantageous for the substrate to have sufficient temperature resistance to be able to survive heat treatment of the structural component without damage.

It is another advantage if the substrate allows the impinging particles to sufficiently adhere to the substrate because, in order to form the structural component, it is required that the first impinging particles bond to the substrate so as to form the basis for the particles that follow.

In order to improve the adherence of, in particular, metallic powder particles, the substrate may be provided with an adherence-enhancing layer, for example, a metallic layer, in particular, of silver, platinum, copper or alloys thereof.

Furthermore it is advantageous to provide a layer on the substrate to enable or facilitate the detachment of the structural component from the substrate once it is completed. In particular, one and the same layer may be used to serve as an adherence-enhancing layer on the one hand, and to enable the structural component to detach from the substrate after the deposition process on the other hand.

Moreover, the layer on the substrate may also remain on the structural component after the completed structural component is detached. The layer may, for example, be a platinum alloy, which may additionally serve as a protective layer on the structural component to protect against hot-gas corrosion.

The present method allows in particular the use of casting materials, and particularly of high-temperature resistant casting materials, such as are used for structural component of gas turbines and aircraft engines. Accordingly, nickel-based alloys, iron-based alloys, titanium-based alloys, cobalt-based alloys and the like can be used to manufacture the structural component. It is only required that the respective materials be provided in the form of powder. Other materials that may be used to manufacture structural components according to the present invention are superalloys; i.e., alloys that retain sufficient strength at temperatures up to 90% of their melting point, or at least up to 80% of their melting point. Such superalloys also contain iron, nickel, platinum, chromium or cobalt as a base constituent with respective additions of cobalt, nickel, iron, chromium, molybdenum, tungsten, rhenium, ruthenium, tantalum, niobium, aluminum, titanium, manganese, zirconium, carbon and boron. The respective alloys are marketed under the trade names Stellite, Tribaloy, Hastelloy, Inconel and the like. Examples of such alloys include NiCr19NbMo alloys (Inconel 718) and comparable alloys, such as MAR247, IN713 and the like. Suitable alloys are, in particular, those having the following constituents, which are listed in the order of their proportion in the composition: NiWCoCrAl—TaTiMo alloys, NiCrFeNbMo alloys, NiCoCrAlMo alloys, NiCrCoTiW alloys and MCrAlY alloys (where M is nickel or cobalt).

The materials used for forming the structural component may be present as a powder containing particles of the respective material composition, or as a mixture of powder particles of one or more components of the material. In particular, it is also possible to supply different powders separately during kinetic cold gas spraying and/or to spray a corresponding powder mixture.

Moreover, the materials may be suitably modified by the powder deposition, for example through the addition of suitable oxide powders capable of positively affecting the rigidity and strength of the structural components.

The structural components may be formed homogeneously from the same material in the length, width and thickness directions thereof and/or be produced using the same deposition parameters, respectively, so that an overall homogeneous formation is obtained. Moreover, the structural components may be composed of different layers and/or be different in different regions along their length and width in that the chemical composition may vary, different starting powders (e.g., in terms of particle size) may be used and/or different spraying parameters may be used.

In addition to different layers in the thickness direction and/or different regions along the length and width, it is also possible to provide continuous changes along the different dimensions of the structural component. This can be done during kinetic cold gas spraying by continuously changing the composition of the material being deposited and/or by using different particles sizes of the powders used and/or, more generally, by using different spraying parameters. Accordingly, it is possible to produce any desired gradient in three-dimensional structures.

As for the particles sizes used, a wide variety of powder fractions may be used, such as, for example, powders of nearly uniform particle size or powders with a very wide particle size distribution. When using different powders, for example, according to the components of a material composition, the powders used may have the same or different particle sizes. Thus, for example, when manufacturing a structural component from a nickel-based superalloy material modified by oxide particles, the nickel-based superalloy material may be present as a powder having a particular particle size distribution, while the added oxide particles may have a much smaller particle size and/or a different particle size distribution. In general, but especially in the case of oxide powders, particle sizes may range down to a few micrometers or nanometers.

The structural component so produced can be machined or further processed using any suitable method, and joined to other components. For example, it can be provided with suitable suspension brackets, which may be attached by brazing or welding.

A structural component produced by kinetic cold gas spraying is formed of a microstructure composed of a multitude of particles that are interlinked and deformed by the kinetic gas cold spraying process. Accordingly, it can have a very high density and low porosity. Moreover, depending on the selection of the starting powders, it is possible to obtain a very fine-grained microstructure. Moreover, through the selection of the deposition parameters, it is also possible to adapt the density in the component to specific requirements. In particular, the structural component can be manufactured such that it is free of pores, in particular in the region of a functional surface. Moreover, the porosity may be less than or equal to 1 percent by volume throughout the entire component or portions thereof without the need for further processing steps.

Furthermore, it is possible to achieve a desired chemical composition profile in a defined manner because there is no risk of segregation. In particular, the chemical composition may vary by less than 10 percent from an average or desired composition throughout the entire structural component.

BRIEF DESCRIPTION OF THE DRAWINGS

Other features and advantages of the present invention will become apparent from the following detailed description of exemplary embodiments in conjunction with the accompanying schematic drawings, in which.

DETAILED DESCRIPTION

Figure 1:
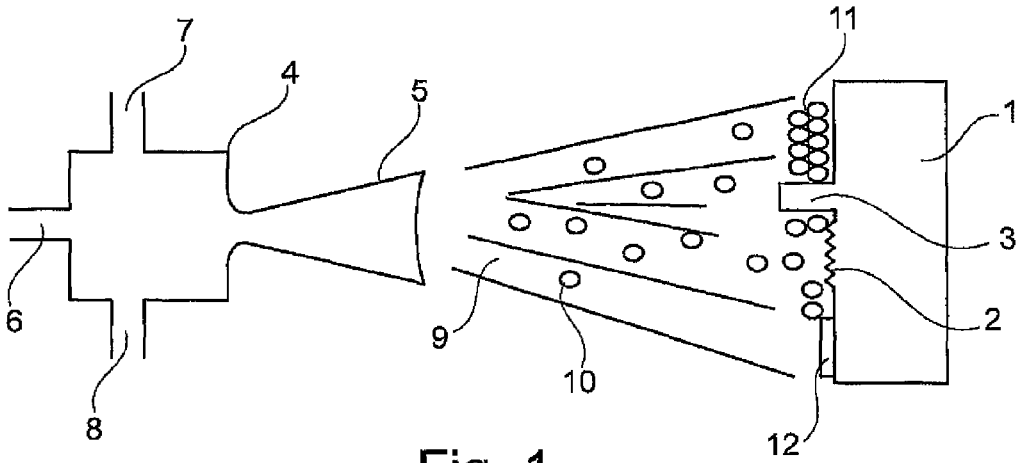
FIG. 1 is a diagrammatic sketch of a system for carrying out the method of the present invention.

FIG. 1 schematically shows a system for manufacturing a thin-wall structural component according to the present invention. The system includes a substrate 1, one side of which serves as a negative mold for a structural component 11. The side of substrate 1 that serves as the negative mold is provided with a patterned surface 2 and a projection 3 for forming an opening to serve as a functional element of the structural component. In a kinetic cold gas spraying process, powder particles 10 are deposited by a spray jet 9 on the side of substrate 1 that serves as the negative mold. To this end, there is provided a cold gas spraying device 4 having a nozzle, e.g., a Laval nozzle 5, where high-pressure process gas is supplied through a process gas supply line 6, so that powder particles supplied through powder particle supply lines 7 and/or 8 exit nozzle 5 at high velocity and are accelerated toward the surface of substrate 1. The velocities of particles 10 in the spray jet may range up to the velocity of sound. It is a feature of kinetic cold gas spraying that powder particles 10 are not superficially or thoroughly melted, and thus, the operating temperature is selected to be below the melting temperature of the material being sprayed.

When particles 10 strike the surface of substrate 1, they are deformed and, due to the strong deformation, a compact and adhering layer is formed on substrate 1, which will then constitute structural component 11.

In order to facilitate adherence of the structural component; i.e., of the deposited particles to substrate 1, which may be problematic, especially in the case of metallic structural components on non-metallic substrates made of ceramics, glass, in particular quartz glass, or stone, such as granite, it is possible to provide a carrier layer 12, which in FIG. 1 is formed only on a portion of substrate 1. Carrier layer 12 may, for example, be a metallic layer, such as silver, copper, platinum or alloys thereof.

In accordance with the present invention, structural component 11 is a thin-walled component made of a casting material, in particular a high-temperature resistant casting material, and is used, in particular, as a structural component of a gas turbine, in particular of an aircraft engine. Examples of such components include guide segments and airfoils, which are used in hot sections of an engine for guiding the hot gases.

Accordingly, the particles 10 deposited on the substrate by kinetic cold gas spraying or kinetic cold gas compacting may be composed of suitable high-temperature resistant casting materials or components thereof, such as nickel-based alloys, iron-based alloys, titanium-based alloys, cobalt-based alloys, superalloys, particularly M247, Inconel IN713 and Inconel IN718, etc.

Due to the high velocity with which particles 10 impinge on the surface of substrate 1, a dense, compact structural component is produced which has a very low porosity, especially on the side of the functional layer; i.e., the side of structural component 11 opposite the substrate. When particles 10 impinge on substrate 1, they are deformed, producing a characteristic microstructure of deformed particles.

Figure 2:
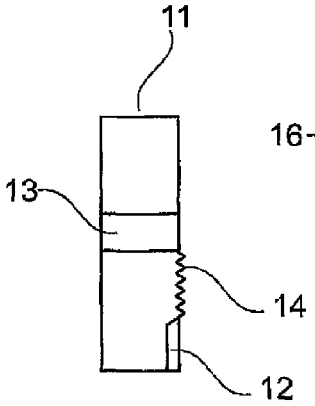
FIG. 2 is a cross-sectional view through a structural component manufactured using the system of FIG. 1.
Figure 3:
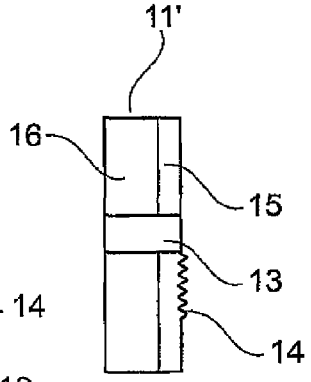
FIG. 3 is a cross-sectional view through a second structural component manufactured using the system of FIG. 1.

FIGS. 2 and 3 show cross-sectional views through completed structural components 11 and 11', which may be produced on substrate 1, In FIGS. 2 and 3, structural components 11 and 11' are shown in a condition detached from substrate 1.

Due to the patterned surface 2 on substrate 1, structural components 11 and 11' each similarly have a patterned functional surface 14 on their functional side; i.e., on the side opposite the substrate surface on which the particles impinge. Furthermore, projection 3 produces a through-hole 13, which is formed in structural component 11 immediately during kinetic cold gas spraying and does not need to be produced later.

The cross-sectional view of FIG. 2 further shows carrier layer 12, which remains as a functional layer on structural component 11 after structural component 11 is detached from substrate 1.

Referring to FIG. 3, there is shown a modified structural component 11', which is composed of two layers 15 and 16 made of different materials. For example, layer 15 on the functional side may be formed from a highly corrosion-resistant high-temperature material such as, for example, MAR 247, while layer 16 on the part of structural component 11' that faces away from the functional side may be formed from a very high strength high-temperature material, such as, for example, Inconel IN718.

In addition to this layered structure, it is also possible to produce continuous gradients, for example, by continuously changing the powder composition during kinetic cold gas spraying and/or by continuously changing the parameters.

Figure 4:
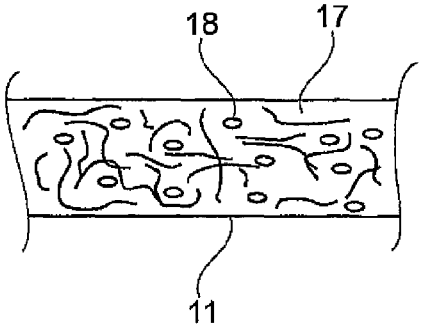
FIG. 4 is a cross-sectional view of a portion of a structural component according to the present invention.

FIG. 4 shows a cross-sectional view through a structural component 11, such as may be produced according to the present invention. Structural component 11 has a microstructure composed of a multitude of particles 17 composed of the respective casting material of structural components 11, such as, for example, a high-temperature resistant nickel-based superalloy. Using the kinetic cold gas compacting method, it is easily possible to introduce additional phases such as, for example, oxides 18 capable of further improving and increasing the rigidity and strength. In the kinetic cold compacting method, this can be easily done by mixing the powder to be sprayed with additional materials. For example, the powder of high-temperature resistant casting material may be mixed with a powder of oxides or, alternatively, oxide powder may be separately added into the gas stream to be deposited together with the casting material. This makes it possible to achieve an even better property profile for the structural component.

Although the present invention has been described in detail with reference to the exemplary embodiments outlined above, those skilled in the art will readily appreciate that the present invention is not limited to these embodiments, but may be modified in such a way that other combinations of the presented features can be implemented and that individual features can be omitted, without departing from the protective scope of the claims below.

In particular, the present invention includes any combination of the herein referred to features.

What is claimed is:

1. A method for manufacturing a thin-walled structural component from a casting material, the method comprising:

providing a powder material;

depositing the powder material by kinetic cold gas spraying on a substrate to form the structural component, a thickness of the structural component or parts of the structural component being 1/10 or less of a length or a width of the structural component; and subjecting the cold gas sprayed structural component to heat treatment together with the substrate, the substrate is at least partially provided with a layer improving an adherence of the cold gas sprayed powder particles to the substrate and/or facilitating detachment of the completed structural component from the substrate, wherein the substrate is made of granite.

2. A method for manufacturing a thin-walled structural component from a casting material, the method comprising:

providing a powder material;

depositing the powder material by kinetic cold gas spraying on a substrate to form the structural component, a thickness of the structural component or parts of the structural component being 1/10 or less of a length or a width of the structural component so that a chemical composition varies in different regions along the length and the width; and subjecting the cold gas sprayed structural component to heat treatment together with the substrate.

3. The method as recited in claim 2 wherein the substrate remains, or parts of the substrate remain, attached to the structural component as an expendable mold.

4. The method as recited in claim 2 wherein the substrate is, or parts of the substrate are, removed from the structural component as a permanent or expendable mold after the structural component is completed.

5. The method as recited in claim 2 wherein the substrate includes a negative mold for at least one functional surface and/or at least one functional element of the structural component.

6. The method as recited in claim 2, wherein the substrate comprises at least one material from the group consisting of ceramics, steel, glass, and stone.

7. The method as recited in claim 2, wherein the powder material includes at least one material from the group consisting of Ni-based alloys, Fe-based alloys, Ti-based alloys, Co-based alloys, and superalloys.

8. The method as recited in claim 2 wherein the structural component is a part of a gas turbine.

9. The method as recited in claim 8 wherein the gas turbine is part of an aircraft engine.

10. The method as recited in claim 9 wherein the structural component is an airfoil.

11. The method as recited in claim 9 wherein the structural component is an air guide segment.

12. The method as recited in claim 2, wherein a thickness of the structural component or parts of the structural component being 1/50 or less of a length or a width of the structural component.

13. The method as recited in claim 2, wherein the substrate is made of hardened steel.

14. The method as recited in claim 2, wherein the substrate is made of quartz.

15. The method as recited in claim 2, wherein the powder casting material includes at least one material from the group consisting of NiWCoCrAlTaTiMo alloys, NiCrFeNbMo alloys, NiCoCrAl—Mo alloys, NiCrCoTiW alloys, MCrAlY alloys (where M is Ni or Co), MAR247, 1N713 and 1N718.

16. The method as recited in claim 2 wherein the substrate includes a negative mold having a projection to form a hole, cutout or recess as a functional element of the structural component.

* * * * *